US008807648B2

(12) United States Patent
Carroll

(10) Patent No.: US 8,807,648 B2
(45) Date of Patent: Aug. 19, 2014

(54) CHAIR CADDY

(76) Inventor: Stephen Carroll, Jacksonville, FL (US)

( * ) Notice: Subject to any disclaimer, the term of this patent is extended or adjusted under 35 U.S.C. 154(b) by 308 days.

(21) Appl. No.: 12/903,393

(22) Filed: Oct. 13, 2010

(65) Prior Publication Data

US 2012/0091765 A1 Apr. 19, 2012

(51) Int. Cl.
*A47C 7/62* (2006.01)

(52) U.S. Cl.
CPC ..... *A47C 7/62* (2013.01)
USPC ..... 297/188.12; 297/188.08; 297/188.13; 297/188.2; 297/188.21

(58) Field of Classification Search
USPC ..... 297/188.08, 188.11, 188.12, 188.13, 297/188.2, 188.21
See application file for complete search history.

(56) References Cited

U.S. PATENT DOCUMENTS 2,765,025 A * 10/1956 Bakalic et al. ..... 297/188.08
2,950,836 A * 8/1960 Murdock ..... 220/576
4,103,965 A * 8/1978 Engman ..... 297/188.12
4,372,605 A * 2/1983 Cervantes ..... 297/188.11
4,624,502 A * 11/1986 Boole ..... 297/188.11
4,745,704 A * 5/1988 Schaefer ..... 43/54.1
4,999,943 A * 3/1991 Crabtree ..... 43/54.1
6,352,303 B1 * 3/2002 Hope ..... 297/188.18
2006/0261646 A1 * 11/2006 McGuire ..... 297/188.08

* cited by examiner

*Primary Examiner* — Philip Gabler
(74) *Attorney, Agent, or Firm* — Mark Young, P.A.

(57) ABSTRACT

A storage assembly for use with a chair. The chair has a seat supported by a framework such as one or more legs. The storage assembly includes at least one storage unit, preferably a plurality of storage units, each having at least one storage feature, such as a recess, drawer, hook, container or case. The storage assembly is attachable to the seat or the supportive framework of the chair below the seat of the chair, and does not protrude substantially therefrom. In an embodiment with a plurality of shelves, the shelves are connected to a support structure such as a pair of side walls. One or more leg attachments operably couple the assembly to one or more chair legs. For example, a leg attachment may connect a wall to a leg. As each shelf is connected to the wall, the leg attachment couples the shelf to the leg, via the wall. The leg attachment may be a pivoting, telescopic arm with a clamp, a belt, snap fit, integrally molded or other suitable connector. The storage assembly may be permanently or removably attached to the chair.

20 Claims, 20 Drawing Sheets

CHAIR CADDY

FIELD OF THE INVENTION

This invention relates to an accessory storage unit, and, more particularly, to an accessory storage unit that is configured to attach to a chair and store items associated with the chair, such as items for feeding and caring for young children in the case of a highchair.

BACKGROUND

People often require items when performing acts around a chair. As one example, a barber requires certain tools. A caregiver requires certain items when caring for a child in a highchair. Unfortunately, such persons often lack a place to store items associated with task at hand. In the case of a caregiver tending to an infant in a highchair, such items may include bottles, nipples, cups, spoons, teething rings, pacifiers, bibs, towels, wipes, and other items associated with feeding young children seated in highchairs. While standard kitchens provide ample storage space for such items, the storage spaces tend to be spread out and inconvenient to access while tending to an infant. A cupboard, cabinet, pantry, closet, table or kitchen countertop may not be within reach of a caregiver and highchair. Some items may be stored in one place while others are stored in other remote places in a kitchen. Thus, retrieving items needed for infant care during feeding may require travel to various parts of a kitchen. Not only is this time consuming, but the infant may be left unattended while the items are being retrieved.

What is needed is a device that stores items associated with a chair or tasks performed using the chair. The device should be attachable to a wide array of chairs. The device should not interfere with use of the chair. The device should not extend out from the chair in a manner that can interfere with traffic patterns or complicates storage. The device should include features for safely and conveniently storing a wide array of items.

The invention is directed to overcoming one or more of the problems and solving one or more of the needs as set forth above.

SUMMARY OF THE INVENTION

To solve one or more of the problems set forth above, in an exemplary implementation of the invention, a chair storage assembly is provided. The chair storage assembly is referred to also as a chair caddy. While an exemplary embodiment described below and shown in the drawings is configured for use with a highchair, the invention is not limited for use with highchairs. Instead, the invention may be applied to any chair having a support framework, such as one or more legs, configured to support the seat of the chair at a height above the ground.

An exemplary chair storage assembly for a chair having a seat supported by a one or more legs includes at least one storage unit, preferably one or more shelves, each having at least one storage feature, such as a recess, drawer, hook or case. The storage unit is attachable to legs of a chair below the seat of the chair, and does not protrude substantially therefrom.

In one exemplary embodiment, the storage unit comprises at least one shelf having a recess, a drawer, a hook, a container or a case. In another exemplary embodiment, the storage unit comprises at least one shelf having a first storage feature, such as a recess, a drawer, a hook, a container or a case, and a width that is less than the width of the chair. Likewise, a second storage unit, such as a second shelf, may have a second storage feature and a width that is less than the width of the chair. Similarly, a third storage unit, such as a third shelf, may have a third storage feature and a width that is less than the width of the chair. The first, second and third storage units include a storage feature from the group consisting of a shelf with a recess, a case, a container, a drawer and a hook. In an embodiment with a plurality of storage units, such as a plurality of shelves, the shelves are connected to a support structure such as a pair of side walls.

Leg attachment means operably couples the assembly to one or more chair legs. For example, the leg attachment means may connect a storage unit or a wall to a leg. In the latter case, as a shelf is connected to the wall, the leg attachment means couples the shelf to the leg, via the wall. The leg attachment means is configured to securely attach to one or more legs of the chair and support the first shelf upright when attached to the legs.

Various types of leg attachment means may be utilized. One example is an attachment arm assembly including a pivoting joint and a clamp, and the clamp being sized to grip a leg of the chair. Optionally, a telescopic segment (i.e., a section of smaller diameter slidingly disposed within a section of larger diameter and slidingly extendable therefrom) is provided between the joint and clamp. As another example, the leg attachment means may include an attachment arm assembly with a ball joint and a clamp, the clamp being sized to grip a leg of the chair. Again, optionally, a telescopic segment is provided between the joint and clamp. As another example, the leg attachment means may be a flexible belt coupled at one end to the first shelf and attached at the other end to a leg of the chair. Optionally, the belt may be stretchable (i.e., elastic).

A storage unit includes a storage feature. One type of storage feature is a case having a base, a lid, a hinge coupling the lid to the base, a closure latch coupled to the lid, a protruding catch on the base in operable alignment with the closure latch. The closure latch releasably engages the protruding catch on the base. Another storage feature includes a recess formed in a second shelf. Yet another storage feature includes a drawer in a shelf. Still another storage feature is a recess in a shelf, with a lid configured to cover the recess, a hinge coupling the lid to the shelf, and a handle coupled to the lid. The lid is pivotable from a closed position covering the recess to an open position exposing the recess. Optionally, at least one hook is attached to a shelf or another storage unit, the hook being configured for hanging objects.

In another embodiment, a chair is provided with a storage assembly as described above, except that the storage assembly may be permanently or removably attached to the chair. The storage unit may be provided as original equipment from a manufacturer. The storage unit may be integrally formed with the chair or attachable to the chair.

In another embodiment, the caddy may be attached such as by clamping to the seat of the chair. Arms extend upwardly from the caddy to the chair. Attachment means on the free ends of the arms, such as attachment clamps, secure the arm to the seat structure, such as the bottom side edges or ribs of the seat. The caddy is maintained in a raised position, i.e., above floor/ground level, and is positioned beneath the seat.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the types of chairs, seats, legs, handle configuration, shapes, relative sizes, ornamental aspects or proportions shown in the figures.

DETAILED DESCRIPTION

Figure 1:
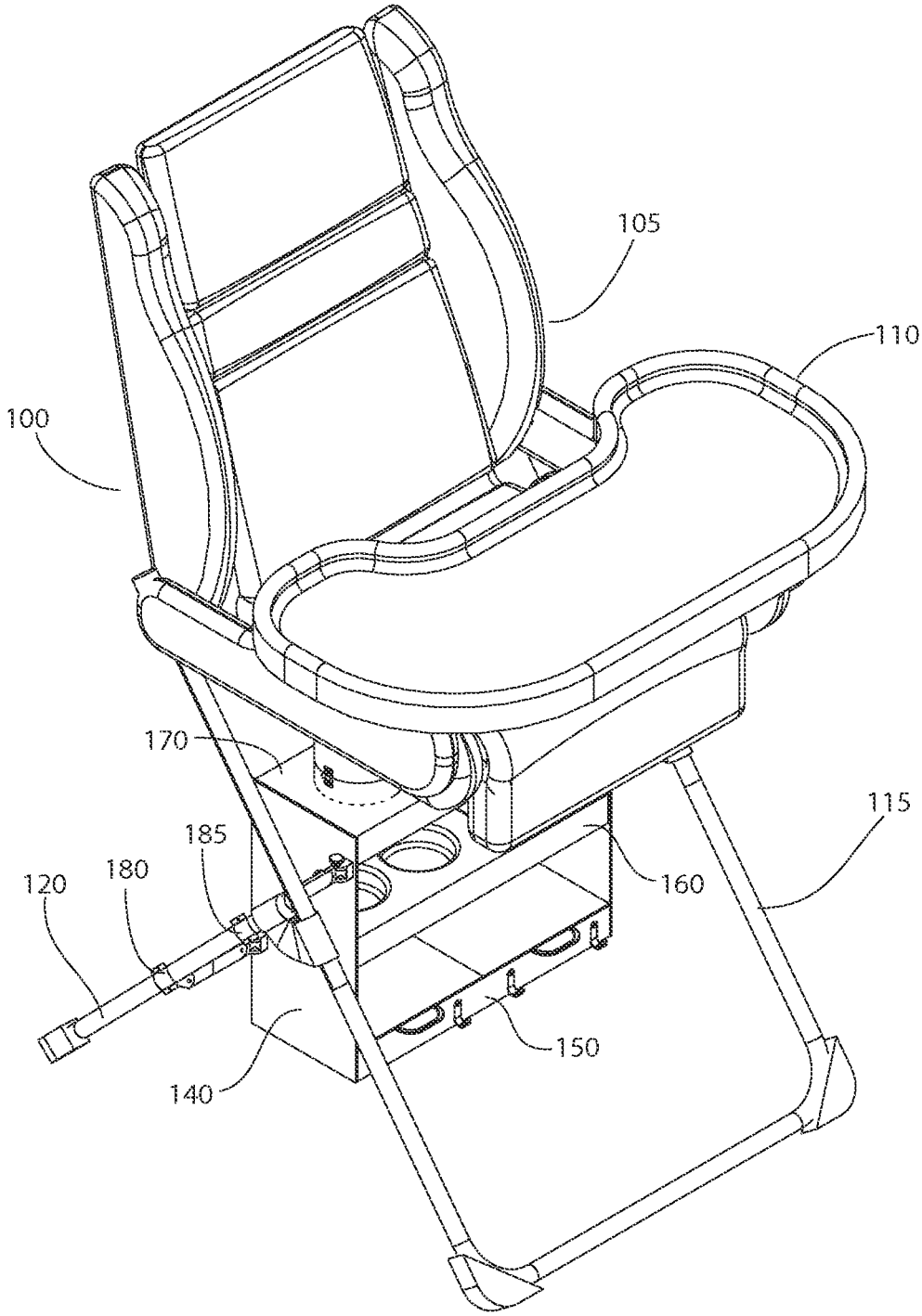
FIG. 1 is a top perspective view of an exemplary highchair and an exemplary chair caddy according to principles of the invention.

In the figures, like parts are indicated with like numbers. Referring first to FIG. 1, a top perspective view of an exemplary chair, in particular a highchair, and an exemplary chair caddy according to principles of the invention are conceptually illustrated. The highchair 100 includes a seat portion 105, a tray 110 and front and back support legs 115 and 120. In this particular embodiment of a highchair, the front support legs and back support legs each comprise a U-shaped assembly. The assemblies serve as a support framework. They are held in an X or Y position to support the seat 105 upright. The legs 115 and 120 may optionally be pivotable from an opened to closed position, and vice versa, to collapse the highchair for storage.

The particular type of chair, and particular type of highchair is not important, so long as the chair includes a support framework to support the seat in a vertically raised position. The support framework may comprise one or more leg segments to which the caddy may be attached. Support of the caddy requires attachment to a support framework such as a leg of the chair.

With continued reference to FIG. 1, the caddy 140 is shown attached to the back legs substantially beneath the seat 105 of the highchair 100. As will be discussed below in more detail, the caddy includes a plurality of shelves 150, 160, 170, each of which includes features, such as compartments, for storage. A plurality of support arms extend from the caddy 140. The free ends of the support arms include clamps 180 and 185 for attachment to legs of the highchair 100.

The invention is not limited to a particular attachment means suitable for attaching the caddy 140 to the support framework, such as to one or more legs of a chair. In the exemplary embodiment shown in FIG. 1, support arms are mountable to the sides of the caddy in positions and configurations that facilitates access to the legs 115 and 120 and maintains upright orientation of the caddy 140. The mounting may be adjustable to accommodate a variety of highchair configurations. The mounting may be accomplished using mechanical attachment hardware such as screws or snap fit plastic interlock fittings. Alternatively, the attachment means may be integrally formed (e.g., molded) with the support framework of the chair. The arms may be elastic, telescopic and/or jointed to allow bending, articulation, extension, retraction and pivoting to reach and connect to the legs. In addition to or in lieu of the legs, D-rings may be attached to the caddy 140 and belts may extend from the D-rings to the legs of the chair to attach to the legs.

Figure 2:
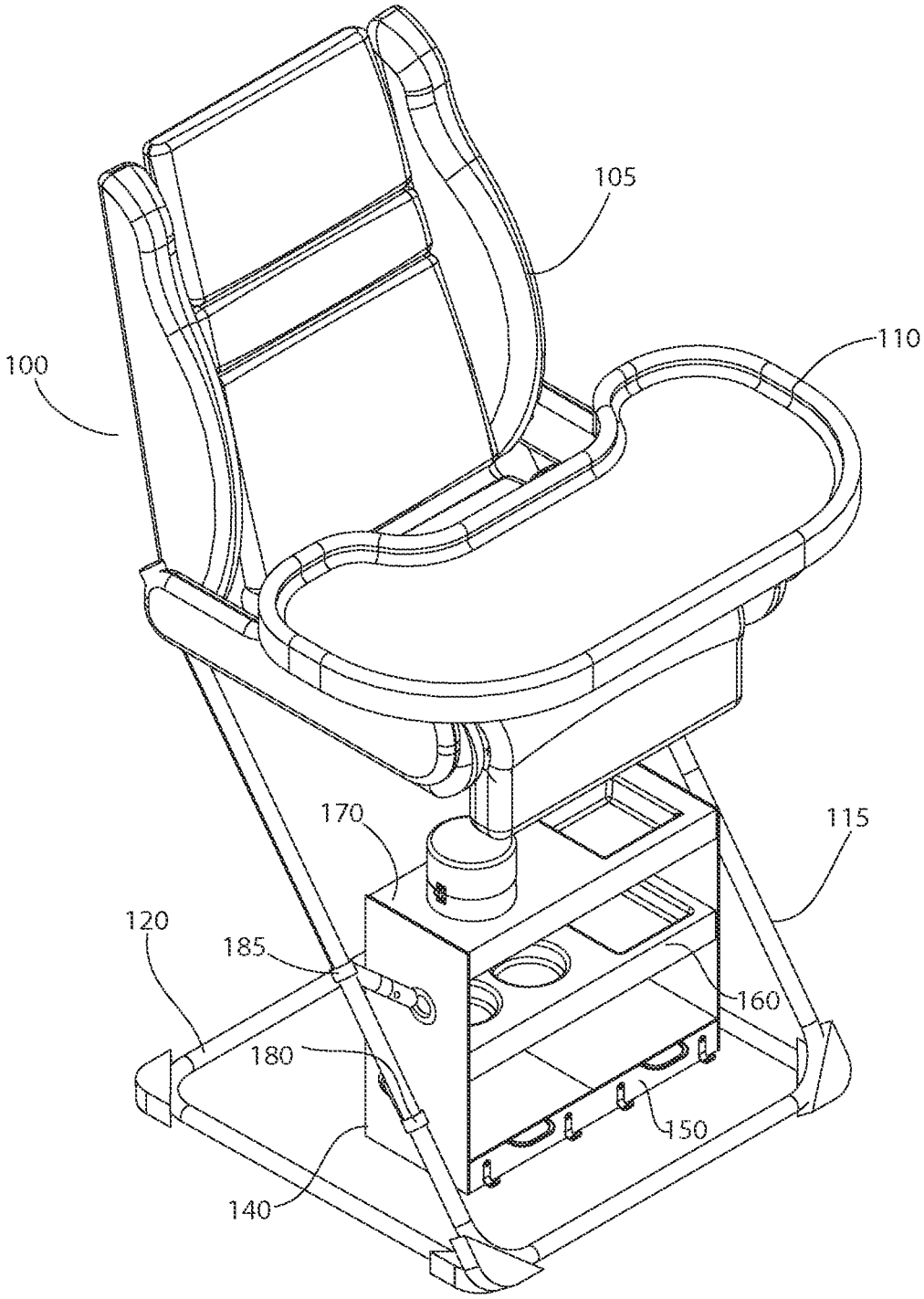
FIG. 2 is a top perspective view of another exemplary highchair and an exemplary chair caddy according to principles of the invention.

With reference to FIG. 2, a top perspective view of another exemplary highchair and an exemplary chair caddy according to principles of the invention is conceptually illustrated. In this embodiment, the highchair 100 includes a different arrangement, of legs 115 and 120, namely, a check mark arrangement with a major segment and an inferior segment at an acute angle relative to the major segment. In this exemplary embodiment, the support arms comprise ball jointed telescopic arms with clamps at the free ends. Again, the invention is not limited to this particular type or arrangement of attachment means for securing the caddy 140 to legs of the highchair.

In general, the caddy 140 comprises an assembly of spaced apart shelves. Each shelf includes storage features for items related to infant care. The shelves are interconnected, in spaced apart relation, by one or more sidewalls or similar support structures. Attachment means configured for connecting the caddy 140 to legs of a highchair are attached to the walls or other support structures.

Figure 3:
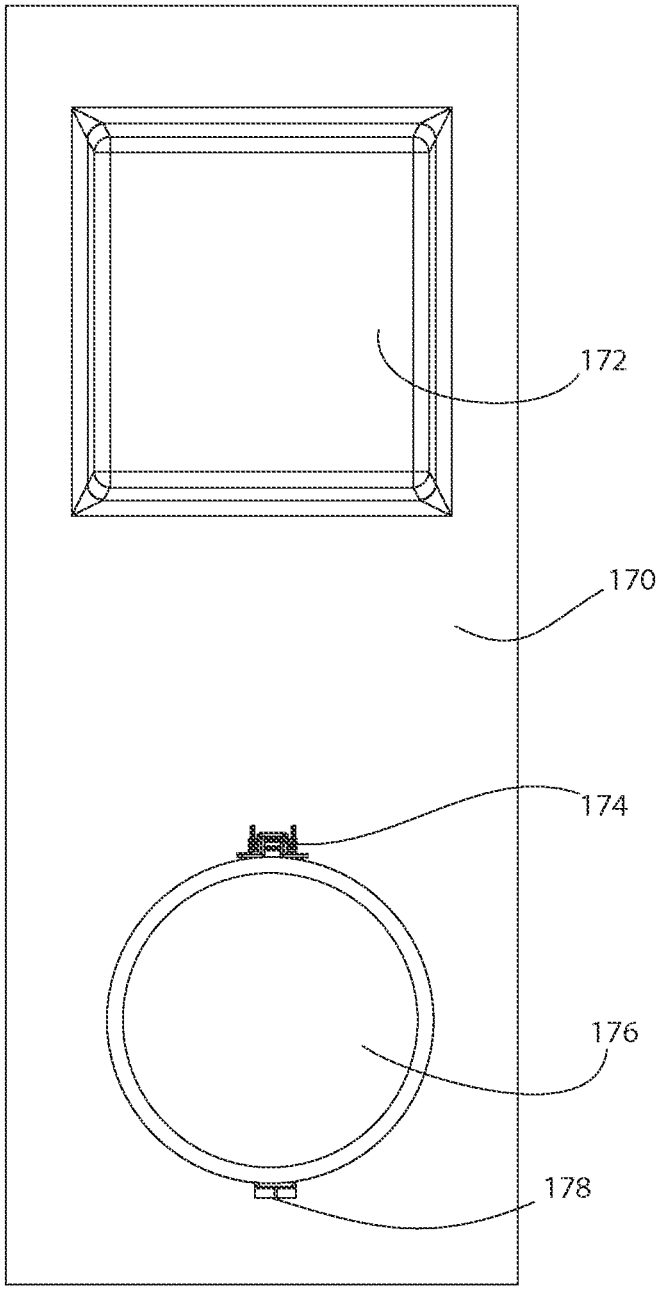
FIG. 3 is a top plan view of an exemplary shelf for an exemplary chair caddy according to principles of the invention.
Figure 4:
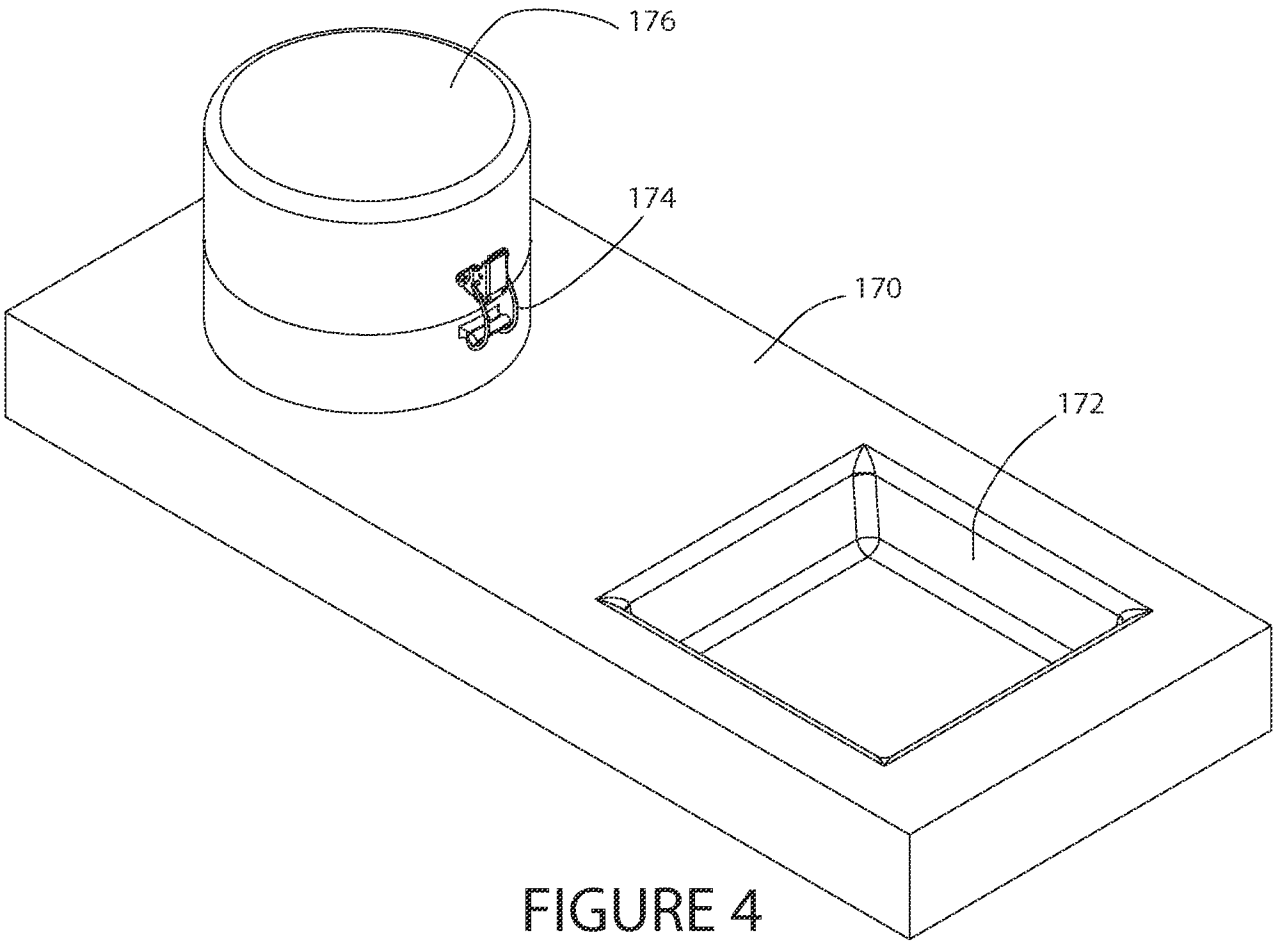
FIG. 4 is a top perspective view of an exemplary shelf for an exemplary chair caddy according to principles of the invention.
Figure 5:
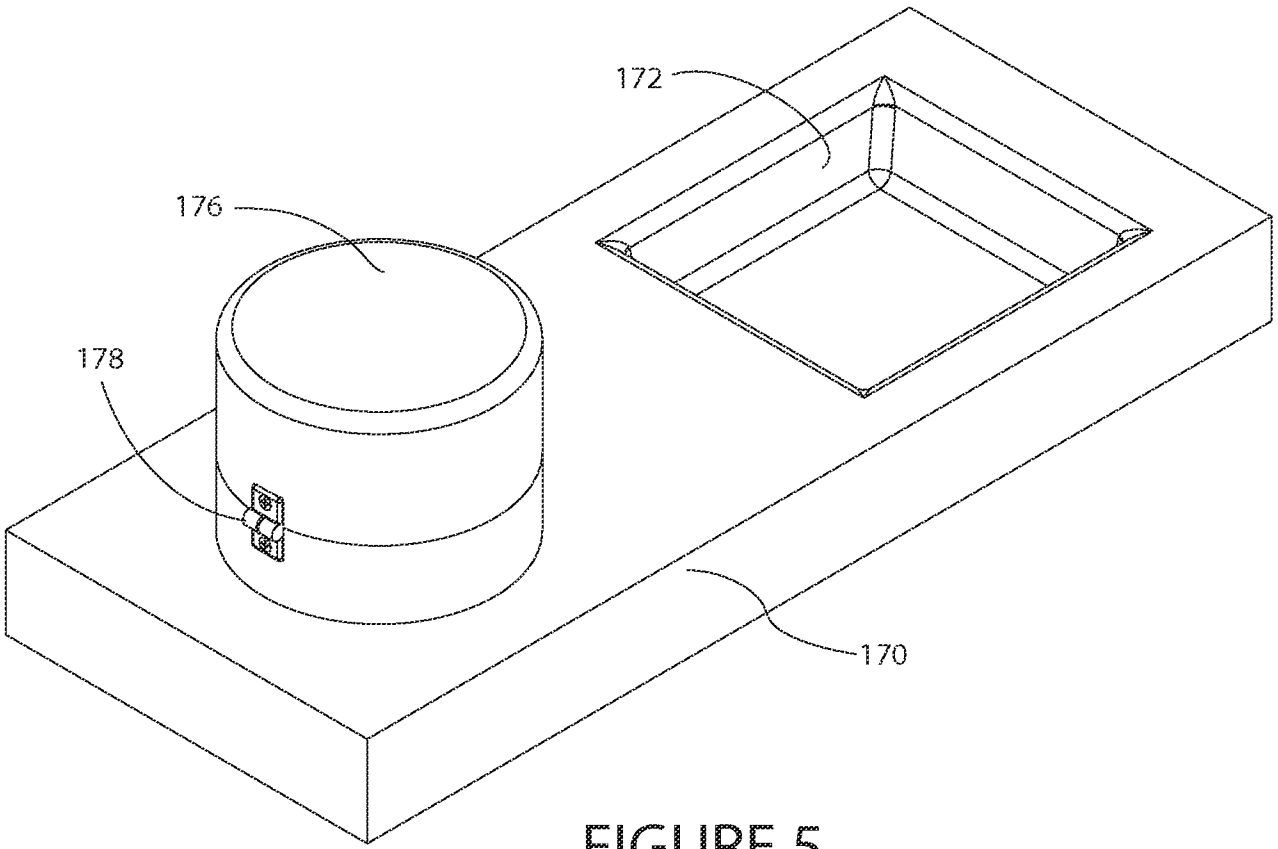
FIG. 5 is another top plan view of an exemplary shelf for an exemplary chair caddy according to principles of the invention.

Referring now to FIGS. 3, 4 and 5 top plan and perspective views of an exemplary shelf 170 for an exemplary chair caddy according to principles of the invention are provided. The exemplary shelf 170 includes a planar support surface with a recess 172 for storing items and a closable case 176 for storing items. A lid is hingedly attached to the base of the case 176 by a hinge 178. A latch 174 secures the lid in a closed position. The latch 174 may comprise a standard mechanical latch or a child-proof safety latch. When the latch is opened, the lid may be raised open for access to the contents of the case 176. Items that a caregiver wants to maintain out of reach of a child can be safely kept in the case 176.

The configuration (e.g., shape, specific location and size) and number of storage features on a storage unit such as a shelf is not particularly important. Thus, a storage unit may have more than one case 176 and more than one recess 172, without departing from the scope of the invention. One or both of these storage features may be omitted from a shelf without departing from the scope of the invention.

Figure 6:
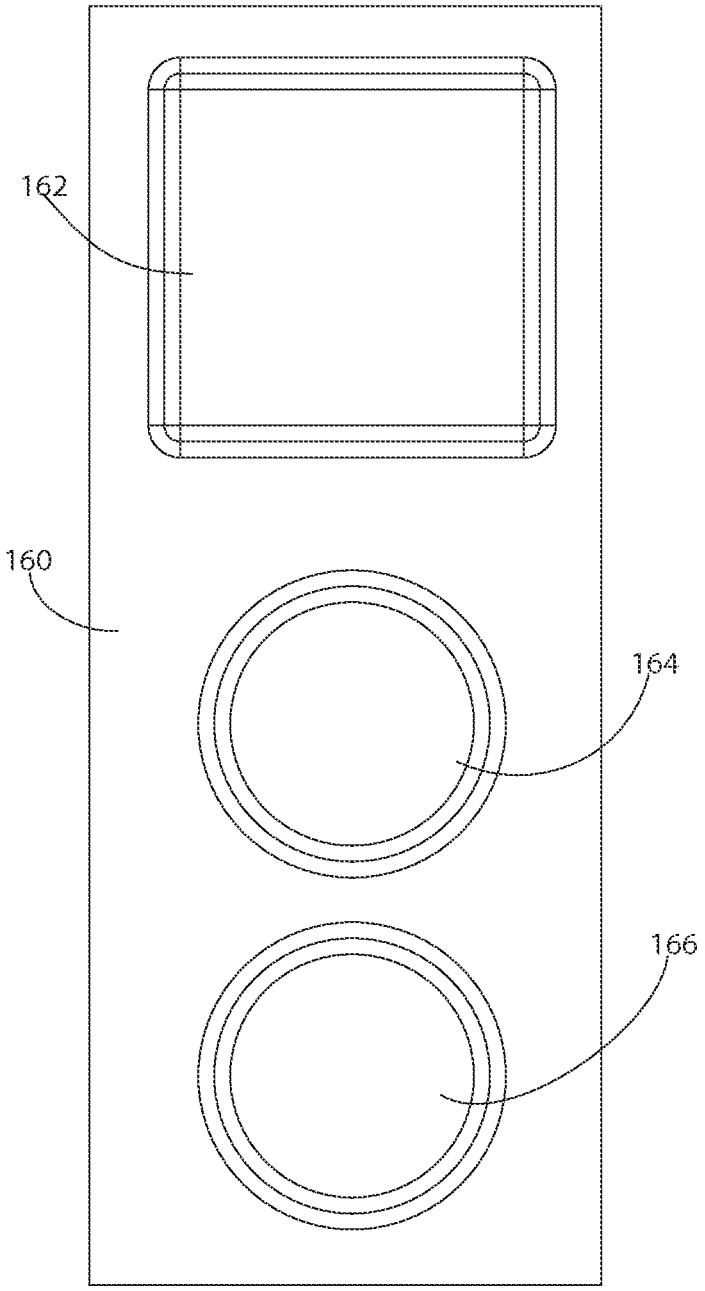
FIG. 6 is a top plan view of another exemplary shelf for an exemplary chair caddy according to principles of the invention.
Figure 7:
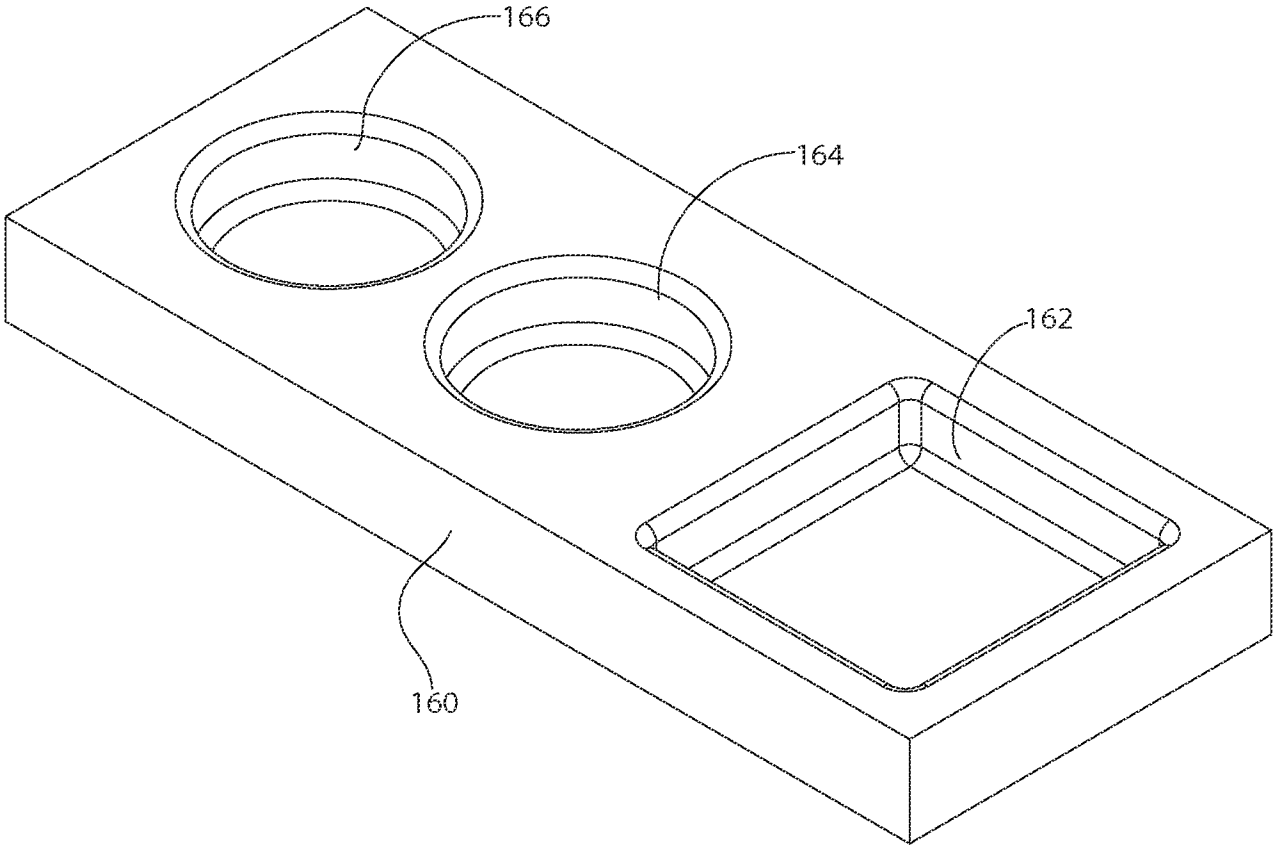
FIG. 7 is a top perspective view of an exemplary shelf for an exemplary chair caddy according to principles of the invention.

Referring now to FIGS. 6 and 7 top plan and perspective views of an exemplary shelf 160 for an exemplary chair caddy according to principles of the invention are provided. The exemplary shelf 160 includes a planar support surface with a plurality of recesses 162, 164 and 166 for storing items. The recesses may accommodate a wide range of objects, including, but not limited to bowls, plates, infant utensils and the like for a highchair, or scissors, combs, brushes, bottles, razors, lotions, sprays, gels and the like for a barber. These objects are merely nonlimiting examples of the types of items that could be stored using a chair caddy according to principles of the invention. The configuration (e.g., shape, specific location and size) and number of storage features on the shelf is not particularly important. Thus, a shelf may have fewer or more than three recesses 162, 164 and 166, without departing from the scope of the invention. One or both of these storage features may be omitted from a shelf without departing from the scope of the invention.

Figure 8:
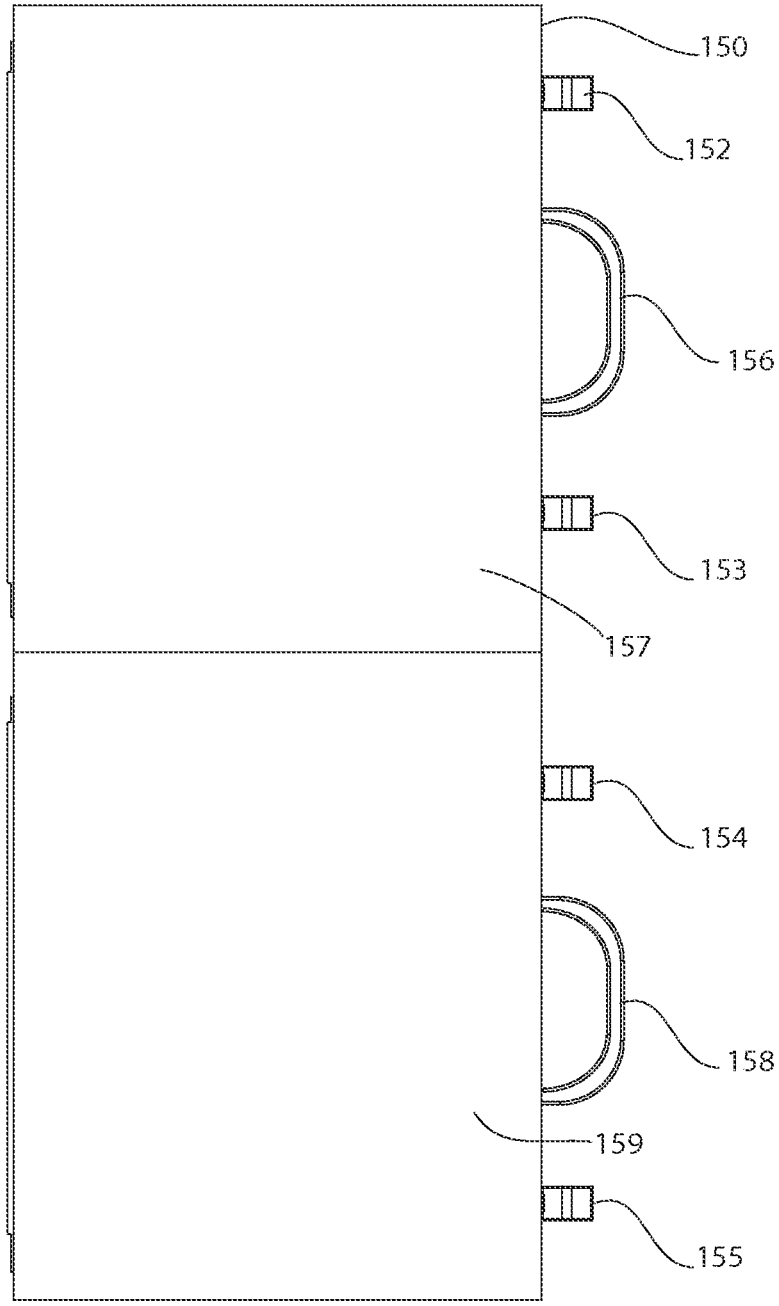
FIG. 8 is a top plan view of another exemplary shelf for an exemplary chair caddy according to principles of the invention.
Figure 9:
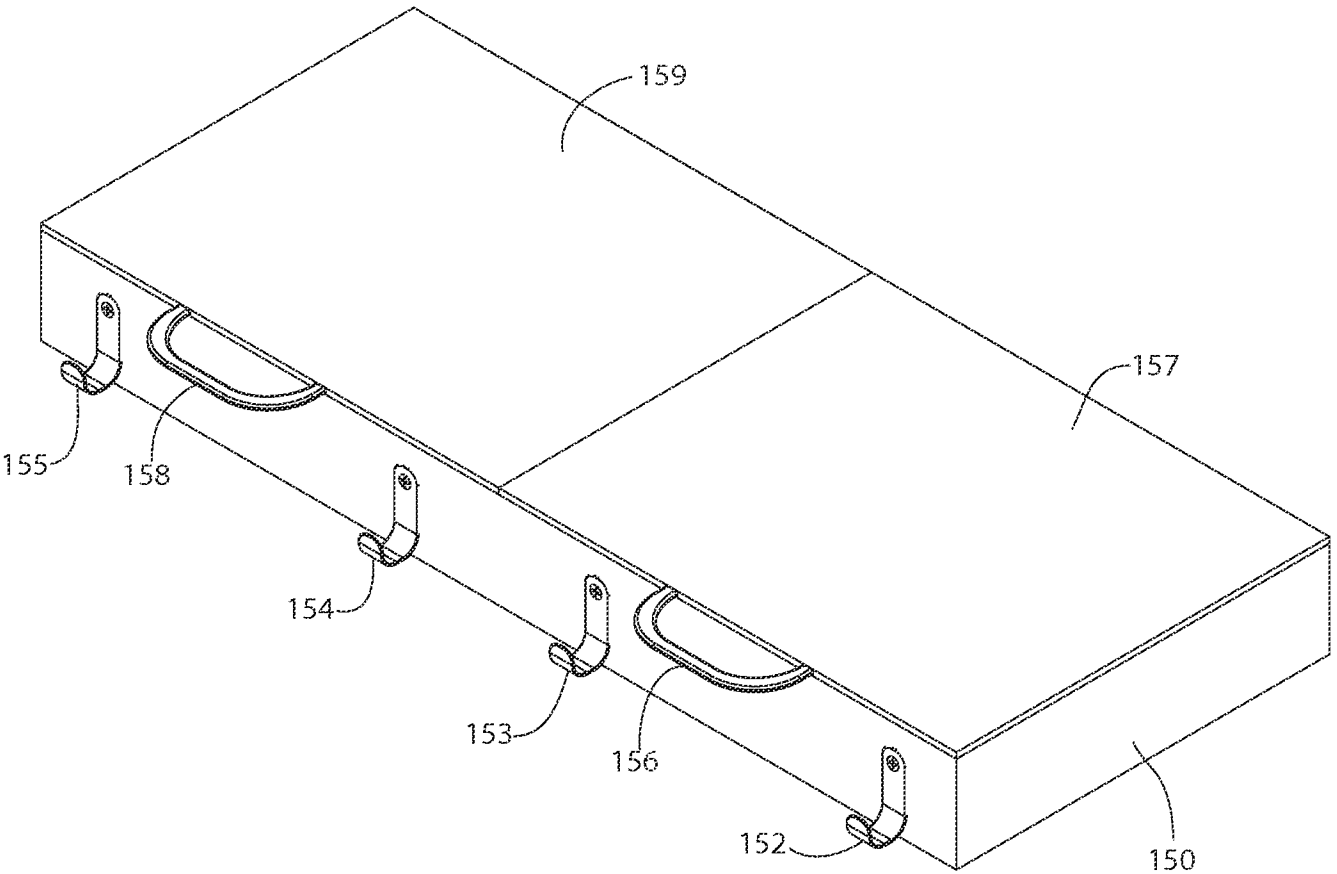
FIG. 9 is a top perspective view of an exemplary shelf for an exemplary chair caddy according to principles of the invention.

Referring now to FIGS. 8 and 9 top plan and perspective views of another exemplary shelf 150 for an exemplary chair caddy according to principles of the invention are provided. The exemplary shelf 150 includes a plurality of drawers or cases for storing items. Hinged lids 157, 159 may be pivotally raised to access the contents of the cases. Alternatively, where drawers are used, the drawers may be pulled open to access the contents. Handles 156, 158 mounted to the lid, facilitate raising and lowering to access the contents. One or more hooks 152, 153, 154 and 155 mounted to the face of the shelf 150 provide hangers from which hangable items, such as bibs, may be hung. The cases or drawers may accommodate a wide range of objects, including, but not limited to utensils, napkins and the like. Again, these objects are merely nonlimiting examples for a highchair. Other types of objects may be stored in the chair caddy. Optionally, the drawers and/or cases may be equipped with child-proof closures that resist full opening unless a biased latch is released. The configuration (e.g., shape, specific location and size) and number of storage features on the shelf is not particularly important. Thus, a shelf may have fewer or more than two cases or drawers 157 and 159, without departing from the scope of the invention. One or both of these storage features may be omitted from a shelf without departing from the scope of the invention.

Figure 10:
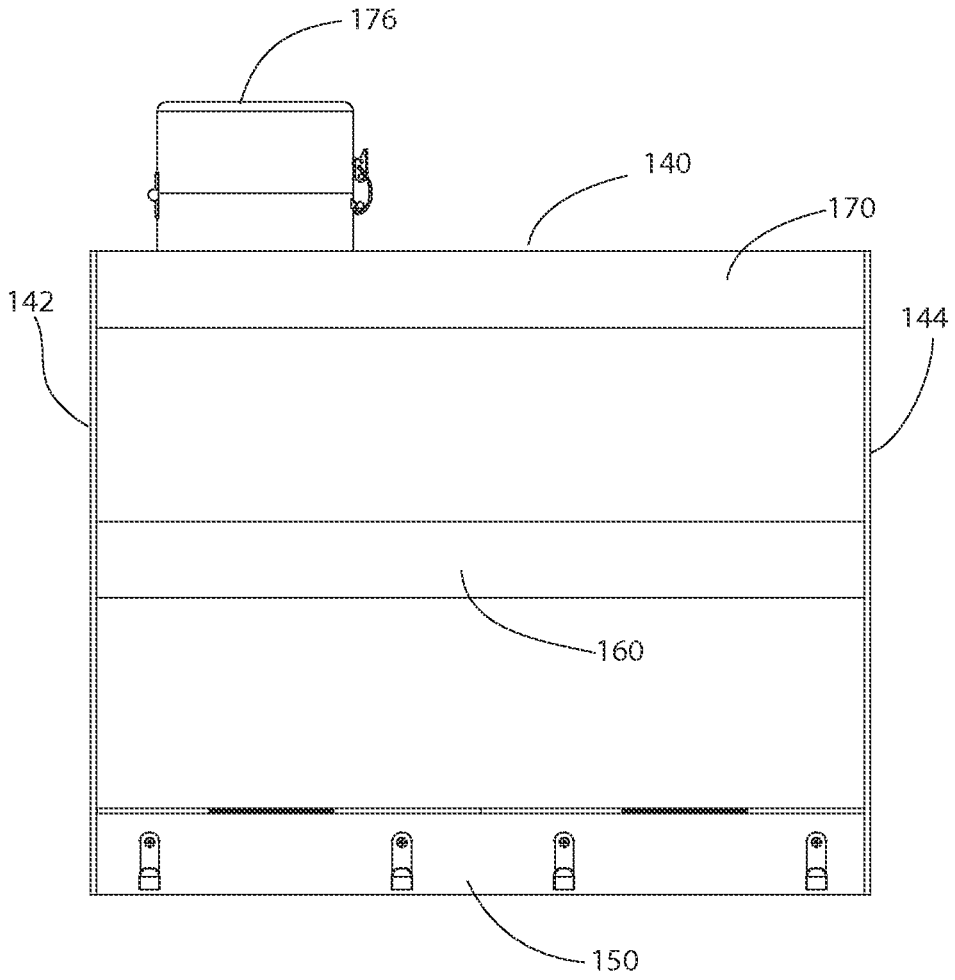
FIG. 10 is a front view of an exemplary caddy assembly, without attachment arms, according to principles of the invention.
Figure 11:
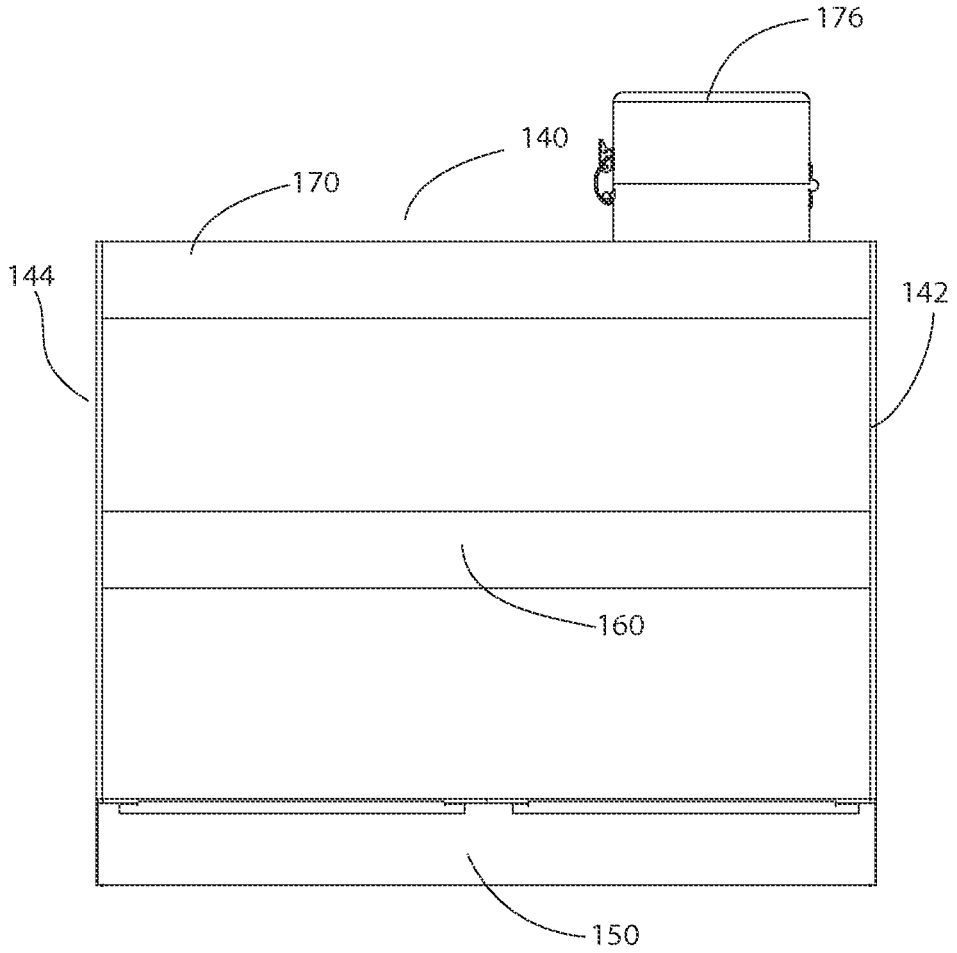
FIG. 11 is a back view of an exemplary caddy assembly, without attachment arms, according to principles of the invention.
Figure 12:
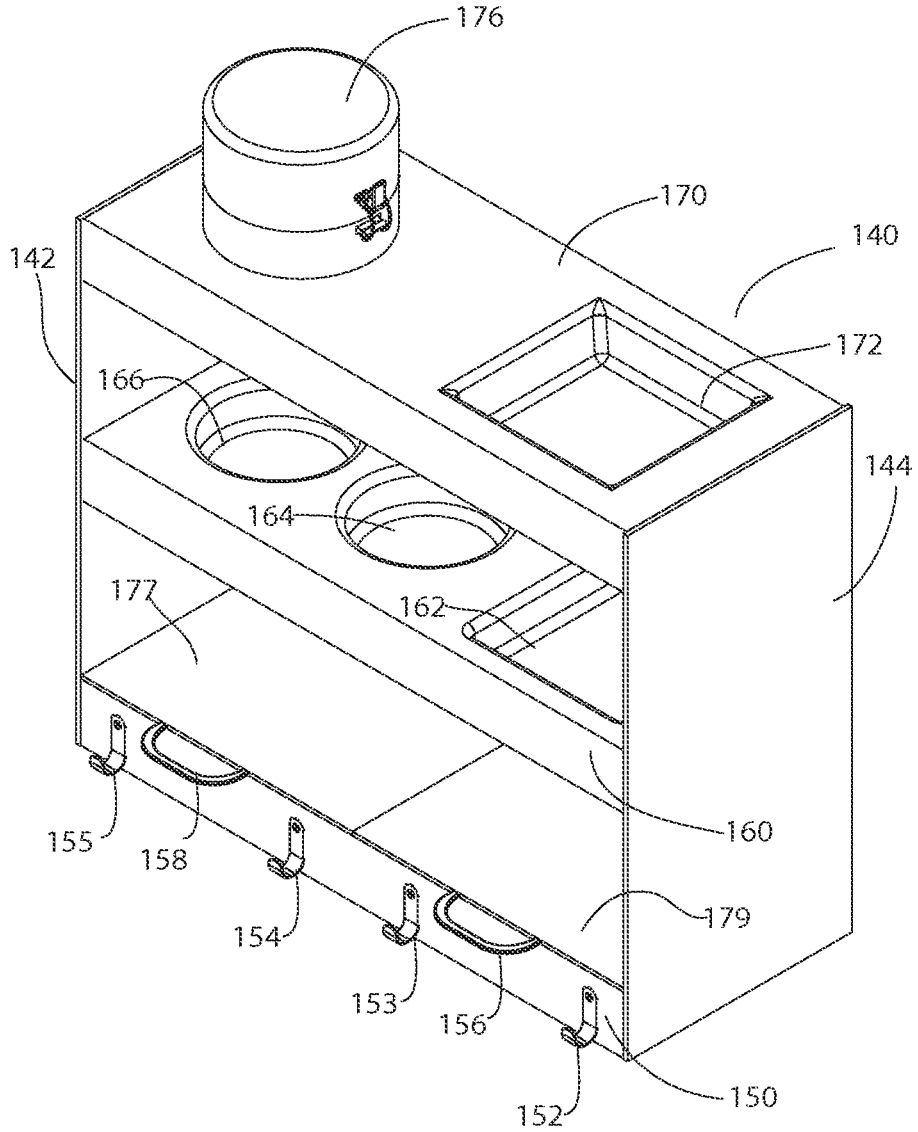
FIG. 12 is a top perspective view of an exemplary caddy assembly, without attachment arms, according to principles of the invention.
Figure 13:
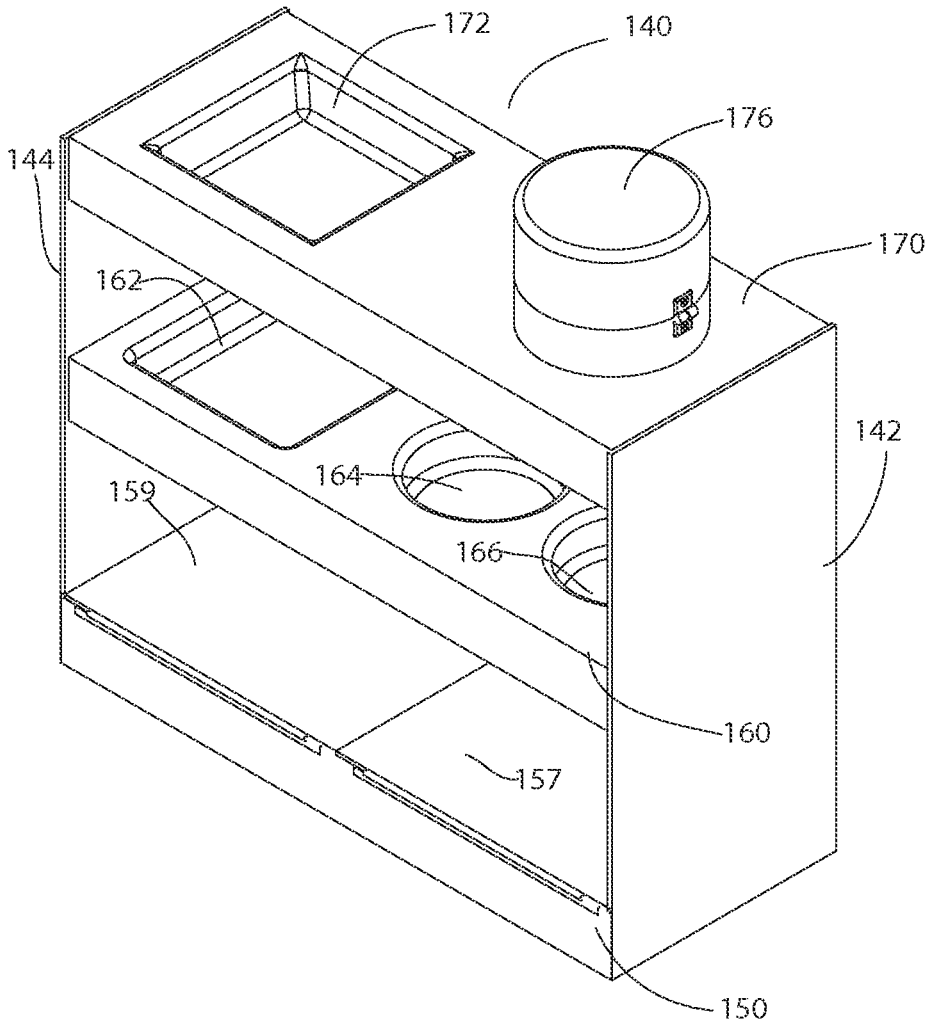
FIG. 13 is a top perspective view of an exemplary caddy assembly, without attachment arms, according to principles of the invention.

Referring now to FIG. 10, a front view of an exemplary caddy assembly, without attachment arms, according to principles of the invention is provided. A rear view is provided in FIG. 11. Top front and top back perspective views are provided in FIGS. 12 and 13 respectively. As shown, each of the three exemplary shelves 150, 160 and 170 is attached to side walls 142 and 144. The order and arrangement of the storage units, such as shelves, are not particularly important and may be varied without departing from the scope of the invention. Additionally, the caddy 140 may comprise fewer or more than three storage units without departing from the scope of the invention.

The shelves 150, 160 and 170 may be attached to the walls 142 and 144 using any suitable attachment means, including but not limited to support brackets, snap-fit fittings, screws, nuts and bolts and glues. Additionally, channels for receiving the shelves may be formed in the side walls. As another alternative, the shelves may be chemically and or thermally bonded to the walls. As yet another alternative, one or more shelves may be integrally formed with the wall.

Figure 14:
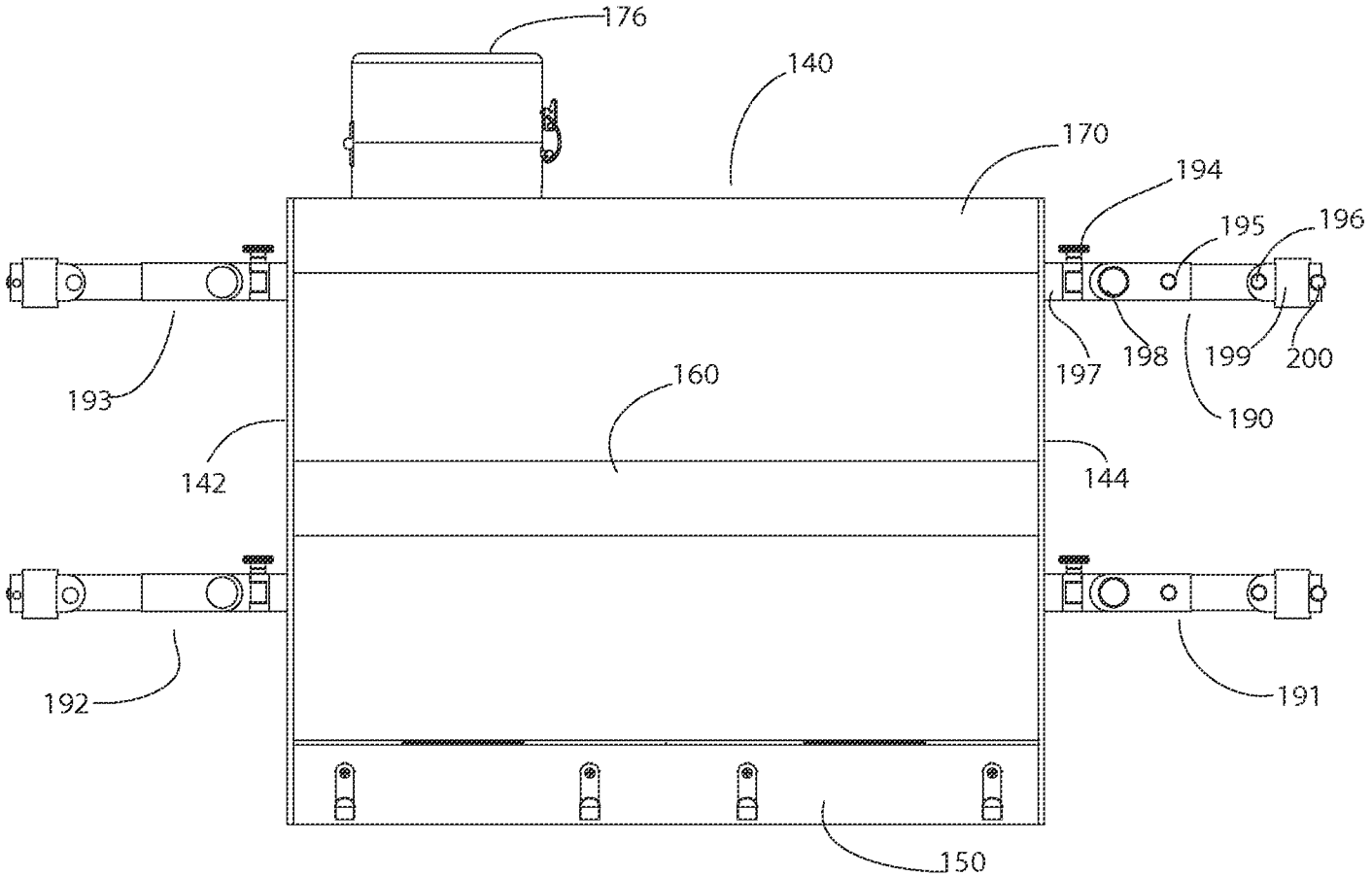
FIG. 14 is a front view of an exemplary caddy assembly, with attachment arms, according to principles of the invention.
Figure 15:
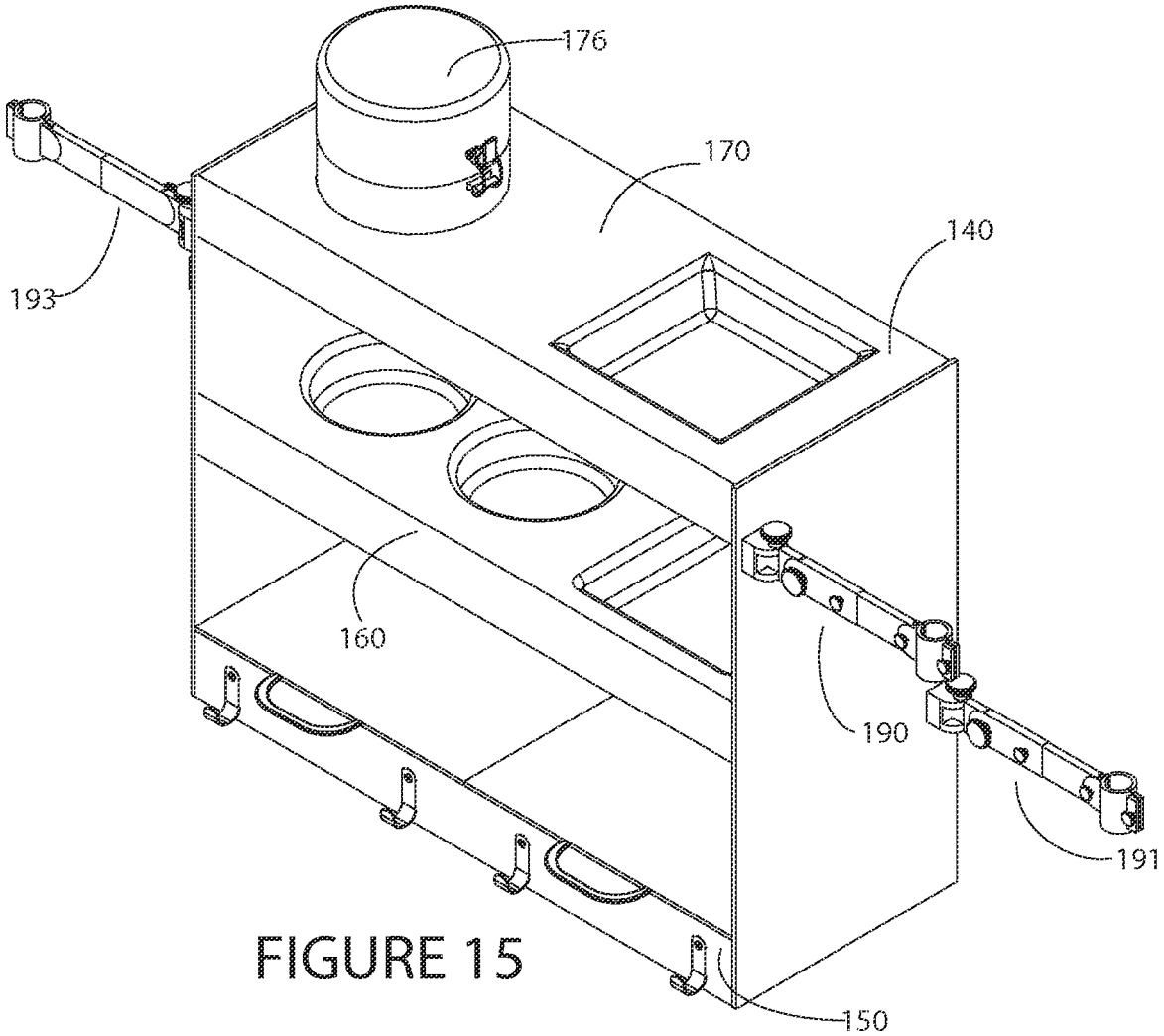
FIG. 15 is a top perspective view of an exemplary caddy assembly, with attachment arms, according to principles of the invention.
Figure 16:
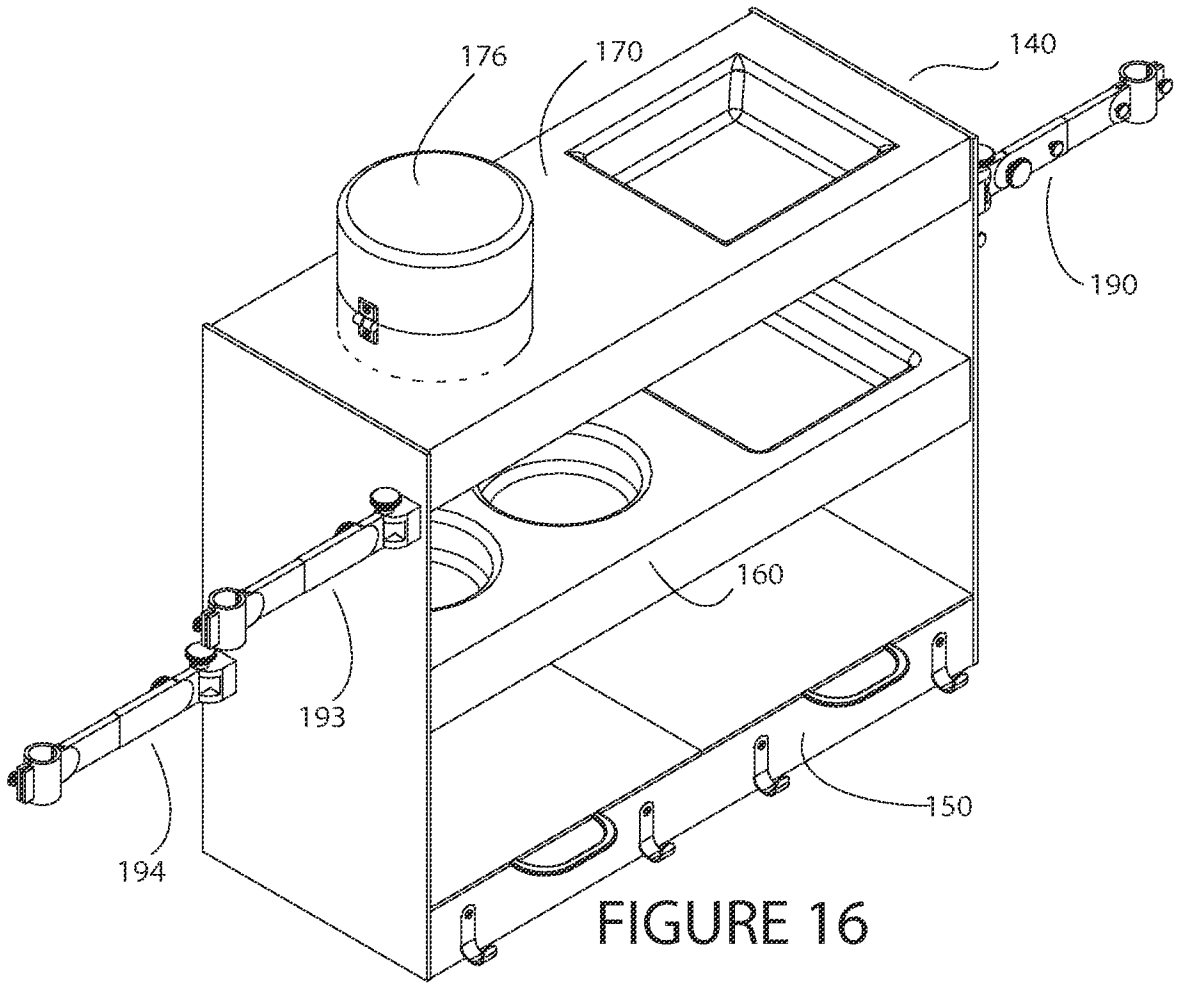
FIG. 16 is a top perspective view of an exemplary caddy assembly, with attachment arms, according to principles of the invention.

Referring now to FIG. 14, a front view of an exemplary caddy assembly, with attachment arms, according to principles of the invention is provided. Top front and top back perspective views are provided in FIGS. 15 and 16 respectively. As shown, each of the three exemplary shelves 150, 160 and 170 is attached to side walls 142 and 144. A plurality of pivoting attachment arms 190, 191, 192, 193 are attached to the walls in a configuration that facilitates attachment to legs of a chair 100.

Each exemplary attachment arm includes a pivoting base 197 with a locking thumb screw 194. The base 197 allows horizontal pivoting motion. The thumb screw locks the arm in a desired position. Each attachment arm also includes a vertically pivoting elbow set by another thumb screw 198. The elbow allows up and down pivoting motion of the arm. Each exemplary attachment arm also includes a telescopic segment to allow lengthening and/or shortening the arm. A thumb screw locks the length. Each arm also includes a pivoting joint or ball joint near the free end of the arm, again locked by a thumb screw 196. This joint enables proper orientation of the leg clamp 199 for engaging a leg of the chair. Another thumb screw 200 is provided to tighten the clamp 199 on the leg. Optionally, each pivoting joint may be replaced with a ball joint.

Figure 17:
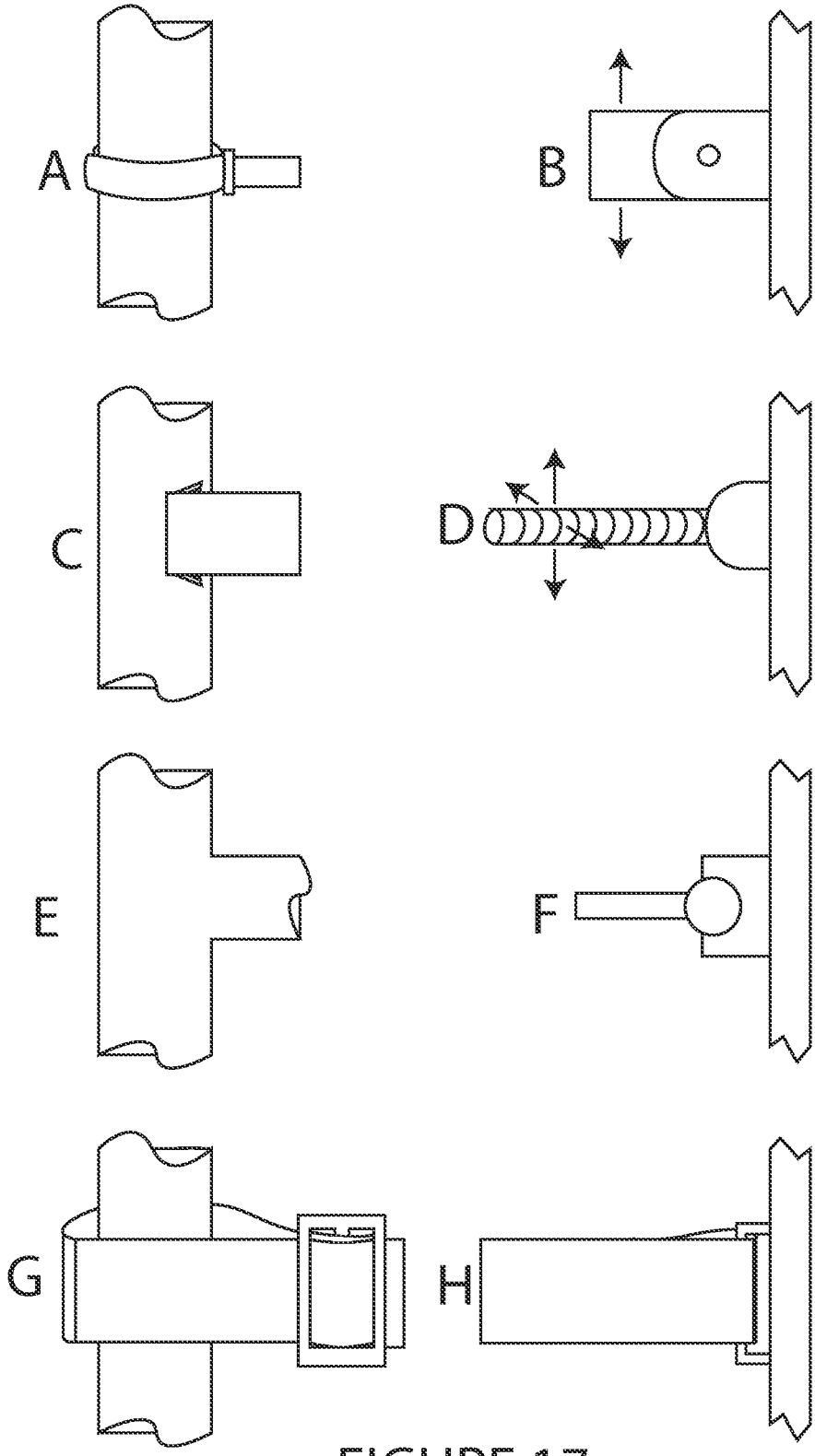
FIG. 17 is a schematic that conceptually illustrates portions of exemplary attachment means according to principles of the invention.

Leg attachment means, other than the attachment arms described above, may be utilized without departing from the scope of the invention. In each case, the leg attachment means is strong enough to support the caddy, includes a free end that securely engages the leg of a chair and is configured to stably support the caddy 140. Pivoting joints (such as B in FIG. 17) and swivel joints (such as F in FIG. 17) may be used to facilitate adjustment. Nonlimiting examples of alternative leg attachment means include resilient and/or non-resilient adjustable length belts (such as H in FIG. 17) attached to the caddy, such as through D-rings formed on or attached to the outside surfaces of the side walls. The end of the belt may be wrapped around and frictionally engage the leg of the chair (such as G in FIG. 17). As another example, flexible plastic arms may extend from the walls and include a claw-like clamping member (such as A in FIG. 17) as a free end. As another example, flexible tubing "gooseneck" arms (such as D in FIG. 17) with clamping members (such as A in FIG. 17) as free ends may extend from the wall. Clamping members (such as A in FIG. 17) may be mechanically tightened such as by using screws or biased into a closed position such as by using springs, elastic bands or elastic gripping components. Snap fit connections (such as C in FIG. 17) and integrally formed connections (such as E in FIG. 17) may also be used. Screws, nuts, bolts and other attachment hardware may be used to create a connection between an attachment means and the support framework.

Figure 18:
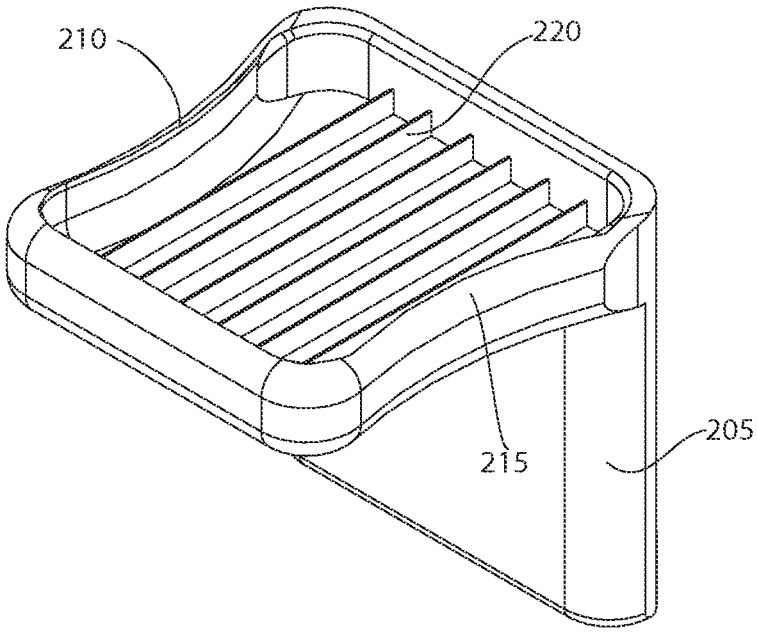
FIG. 18 is a bottom perspective view of an exemplary seat according to principles of the invention.

Referring now to FIG. 18, a bottom perspective view of an exemplary seat 205 according to principles of the invention is provided. The seat 205 is a plastic molded structure. The bottom of the seat 205 includes structural formations such as ribs 220. Side edges 210 and 215 define the right and left sides of the seat. As an alternative to gripping legs of a chair, a caddy according to principles of the invention may include arms and clamps to grip a portion of a seat 205, including, but not limited to, the side edges 210 and 215 and/or structural formations such as ribs 220.

Figure 19:
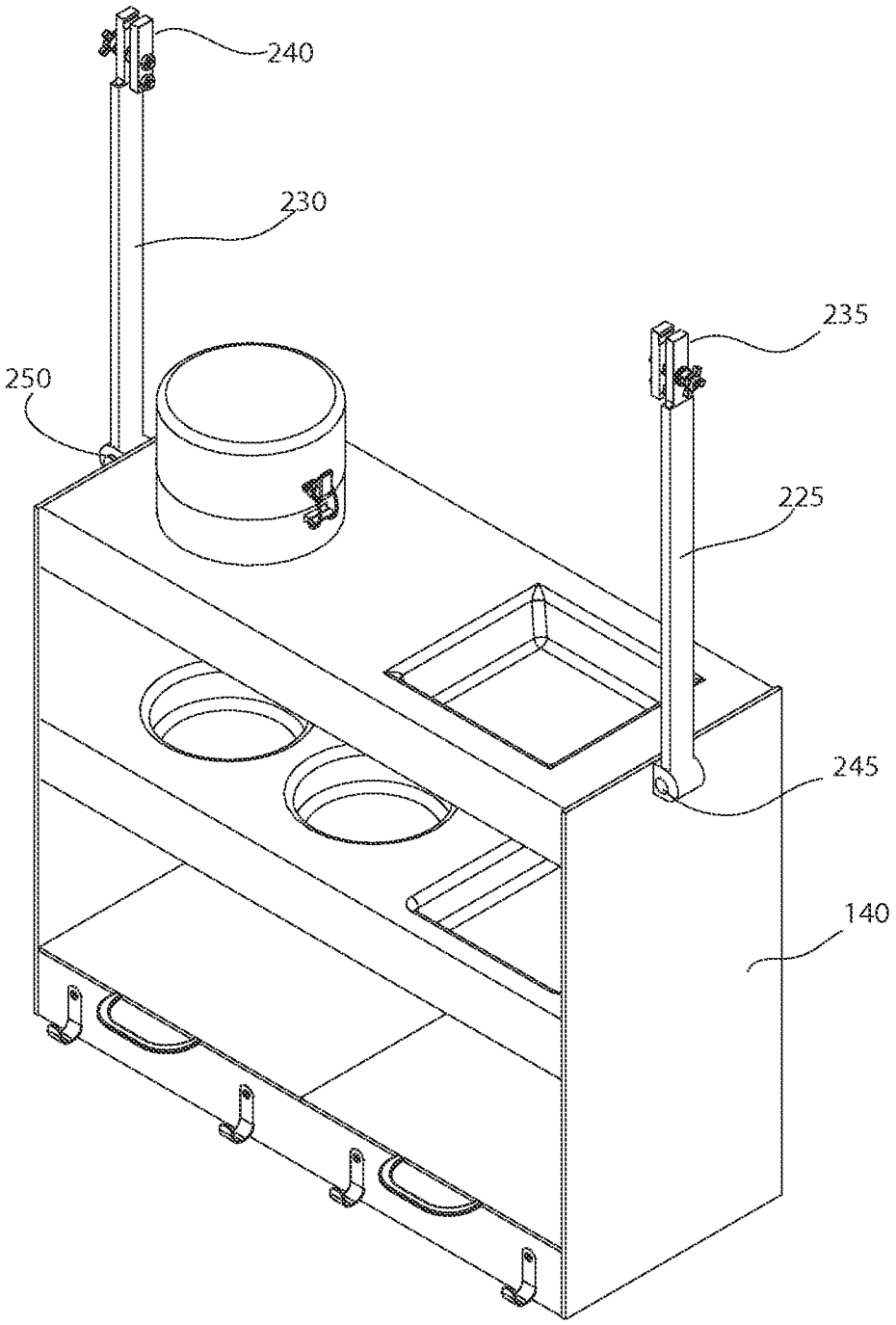
FIG. 19 is a top perspective view of another exemplary chair caddy with upwardly extending support arms according to principles of the invention.

Illustratively, in FIG. 19 a top perspective view of an exemplary chair caddy 140 with upwardly extending support arms 225, 230 according to principles of the invention is provided. The arms may be telescopic, jointed, or unitary, and flexible or rigid. A pivoting joint 245, 250 connects each arm to the caddy 140. Clamps 235, 240 are attached to the free end of each arm 225, 230. The clamps 235, 240 include a pair of opposed clamping jaws and a means for controllably urging the clamping jaws towards each other. In the embodiment shown in FIG. 19, the clamps include a threaded means for urging the jaws towards each other.

Figure 20:
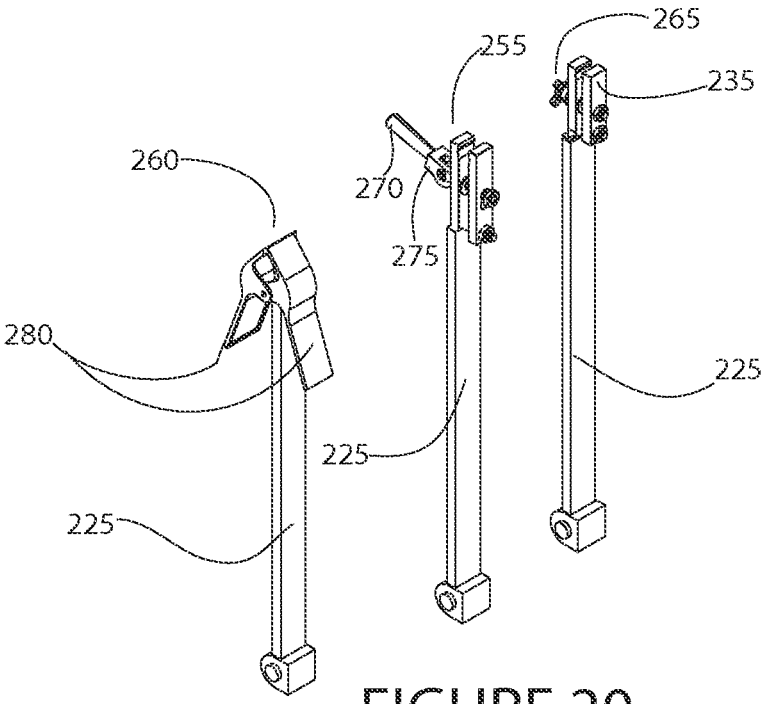
FIG. 20 is a first perspective view of exemplary upwardly extending support arms according to principles of the invention.
Figure 21:
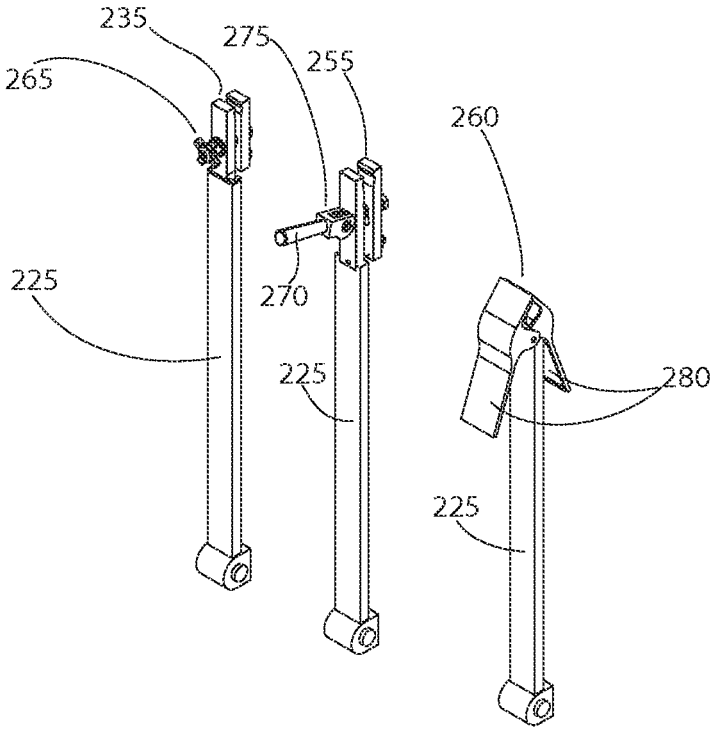
FIG. 21 is a second perspective view of exemplary upwardly extending support arms according to principles of the invention.

Referring now to FIGS. 20 and 21 perspective views of exemplary upwardly extending support arms according to principles of the invention are provided. In each nonlimiting example, the arms may be telescopic, jointed, or unitary, and flexible or rigid. A clamp, such as a threaded clamp, cam clamp or spring clamp, is attached to the free end of each arm 225. The exemplary threaded clamp includes a knob 265 with a threaded bore that threadedly receives a threaded shaft that passes through an aperture in one of the clamping jaws and is connected to the opposed clamping jaw 235. Advancing the knob exerts force on the other clamping jaw, urging it towards the clamping jaw connected to the shaft. A compression spring may be provided between the clamping jaws to urge them apart.

Another embodiment includes a cam 275 with a lever handle 270. Using the handle 270, the cam 275 may be pivoted from a low point to a high point. A compression spring may be provided between the clamping jaws to urge them apart. When the cam 275 is at the low point, the jaws 255 are spaced apart in an open position. The spacing may be adjusted with adjustment screws. When the cam 275 is pivoted to the high point, the cam urges one jaw towards the other, thereby substantially reducing the space between the jaws. A shaft passes through an aperture in the clamping jaw adjacent to the cam 275 and is connected to the opposed clamping jaw. Pivoting the cam from a low point to a high point exerts force on the adjacent clamping jaw, urging it towards the clamping jaw connected to the shaft.

Yet another embodiment includes a spring clamp 260. A pair of opposed clamping jaws may be pivoted from a spring-biased closed position to an open position by urging handles 280 towards each other.

These and other types of clamps may be used to securely grip a portion of the bottom of the seat 205, without interfering with use of the seat 205. Resilient gripping pads, textured surfaces, and/or materials exhibiting high coefficient of friction, may be formed on and/or attached to the gripping surfaces of the opposed jaws of the clamp.

In lieu of or in addition to a clamp, fasteners may be used to secure the upwardly extending arms to the seat. For example, a nut and bolt may secure the free end of the upwardly extending arm to the side edge or a rib of a seat bottom. A hole may be bored through the edge or rib for receiving the bolt.

Components of a caddy according to principles of the invention may be manufactured using materials and manufacturing techniques that are now known and hereafter developed and suitable for producing sturdy goods suitable for use around infants, children and adults, and in various environments including homes, industrial and business. For example, the shelves, storage features and arms may be substantially comprised of a plastic or polymeric material, such as polyvinyl chloride (PVC), nylon, polysulfone, polyethylene, polypropylene, polystyrene, acrylics, cellulosics, acrylonitrile-butadiene15 styrene (ABS) terpolymers, urethanes, thermo-plastic resins, thermo-plastic elastomers (TPE), acetal resins, polyamides, polycarbonates and/or polyesters. Other suitable polymeric compositions are known to those familiar with the art and may also be used in accordance with the present invention. Preferably the chosen material is relatively inexpensive, produces a rigid, durable and strong product, is easy to use in manufacturing operations and results in an aesthetically acceptable product. The material may further include additives to provide desired properties such as desired colors, structural characteristics, glow-in-the dark properties and anti-bacterial properties.

Hardware, belts, trim, and accessories may be comprised of a wide array of materials, including, but not limited to plastics, rubbers, woods, metals.

Illustratively, phosphorescent polymer additives, such as aluminate based phosphors, may be added to adsorb light energy and continue to release that energy as visible light, after the energy source is removed. Advantageously, such an embodiment provides a caddy that is easy to locate, enabling the caddy to shine in a dark room. As a light emitting object it is not only easy to locate in a dark room, but easy to avoid hitting in a dark room.

The caddy components may be produced using any suitable manufacturing techniques known in the art for the chosen material, such as (for example) injection, compression, structural foam, blow, or transfer molding; polyurethane foam processing techniques; vacuum forming; casting; and extrusion. Preferably the manufacturing technique is suitable for mass production at relatively low cost per unit, and results in an aesthetically acceptable product with a consistent acceptable quality and structural characteristics.

While the exemplary embodiments described above illustrate an attachable aftermarket product, those skilled in the art will appreciate that a caddy according to principles of the invention may be formed as original equipment. By way of example and not limitation, an attachment arm connected to a leg or seat of a chair may be integrally formed with the leg or seat or otherwise attachable to the leg or seat, without departing from the scope of the invention.

While an exemplary embodiment of the invention has been described, it should be apparent that modifications and variations thereto are possible, all of which fall within the true spirit and scope of the invention. With respect to the above description then, it is to be realized that the optimum relationships for the components, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A storage assembly for use with a chair, said chair having a seat supported by a support framework, said framework including a pair of left side legs and a pair of right side legs, said pair of left side legs being spaced apart from said pair of right side legs, said storage assembly comprising:

a first storage unit comprising a housing having an internal storage compartment, the first storage unit having a width that is less than a width of the chair, and said first storage unit having a left side and an opposite right side, the internal storage compartment comprising a drawer; and the housing of the first storage unit further comprising an external storage shelf and an external storage container on the external storage shelf, said external storage container comprising a recess in the external storage shelf; and at least two independently adjustable elongated attachment arms operably coupled to the first storage unit and configured to securely attach to the support framework of the chair and suspend the first storage unit upright when attached to the support framework, said at least two independently adjustable elongated attachment arms including a right arm extending from the right side of the first storage unit and a left arm extending from the left side of the first storage unit, the right arm having a right distal end with a right distal pivoting joint and a right proximal end with a right proximal pivoting joint and being coupled at the right proximal end to the right side of the first storage unit and being coupled at the right distal end to at least one of the pair of right side legs, the left arm having a left distal end with a left distal pivoting joint and a left proximal end with a left proximal pivoting joint and being coupled at the left proximal end to the left side of the first storage unit and being coupled at the left distal end to at least one of the pair of left side legs;

said storage assembly being sized and shaped to be below seat of the chair and elevated above a ground level when installed on the chair.

2. A storage assembly for a chair, as in claim 1, each of said at least two independently adjustable attachment arms comprising a clamp sized to grip the support framework of the chair.

3. A storage assembly for use with a chair, as in claim 1, the right arm comprising a right ball joint and a right clamp sized to grip the support framework, and the left arm comprising a left ball joint and a left clamp sized to grip the support framework.

4. A storage assembly for use with a chair, as in claim 3, the right arm further including a telescopic segment between the right distal pivoting joint and the right clamp, and the left arm further including a telescopic segment between the left distal pivoting joint and the left clamp.

5. A storage assembly for use with a chair, as in claim 4, the right distal pivoting joint comprising a right ball joint, and the left distal pivoting joint comprising a left ball joint.

6. A storage assembly for use with a chair, as in claim 1, further comprising a flexible belt coupled the first storage unit and the support framework.

7. A storage assembly for use with a chair, as in claim 1, the right arm further comprising a flexible elastic belt coupled to the support framework, and the left arm further comprising a flexible elastic belt coupled to the support framework.

8. A storage assembly for use with a chair, as in claim 1, said storage assembly further comprising a second storage unit having a second storage feature, the second storage unit having a width that is substantially the same as the width of the first shelf, the second storage feature comprising a storage feature from the group consisting of a recess, a case, a container, a shelf and a drawer, said second storage unit being attached to said first storage unit.

9. A storage assembly for use with a chair, as in claim 8, said storage assembly further comprising a third storage unit having a third storage feature, the third storage unit having a width that is substantially the same as the width of the first storage unit, the third storage feature comprising a storage feature from the group consisting of a recess, a case, a container, a shelf and a drawer, said third storage unit being attached to said first storage unit.

10. A storage assembly for use with a chair, as in claim 8, said second storage feature comprising a recess formed in the second storage unit.

11. A storage assembly for use with a chair, as in claim 9, said third storage feature comprising a drawer in the third storage unit.

12. A storage assembly for use with a chair, as in claim 9, said third storage feature comprising a case comprising a recess in the third storage unit, a lid configured to cover the recess in the third storage unit, a hinge coupling the lid to the third storage unit, a handle coupled to the lid, the lid being pivotable from a closed position covering the recess in the third storage unit to an open position exposing the recess in the third storage unit.

13. A storage assembly for use with a chair, as in claim 1, said first storage unit comprising a first storage feature, said first storage feature comprising a case having a base, a lid, a hinge coupling the lid to the base, a closure latch coupled to said lid, a protruding catch on the base in operable alignment with the closure latch, said closure latch configured to releasably engage the protruding catch on the base.

14. An assembled chair comprising a seat, a support framework comprising at least one leg supporting the seat, and a storage assembly beneath the seat and attached to the support framework, said storage assembly comprising:

a first storage unit comprising a housing having an internal storage compartment, the first storage unit having a width that is less than a width of the chair, and said first storage unit having a left side and an opposite right side, the internal storage compartment comprising a drawer; and the housing of the first storage unit further comprising an external storage shelf and an external storage container on the external storage shelf, said external storage container comprising a recess in the external storage shelf; and at least two independently adjustable elongated attachment arms operably coupled to the first storage unit and configured to securely attach to the support framework of the chair and suspend the first storage unit upright when attached to the support framework, said at least two independently adjustable elongated attachment arms including a right arm extending from the right side of the first storage unit and a left arm extending from the left side of the first storage unit, the right arm having a right distal end with a right distal pivoting joint and a right proximal end with a right proximal pivoting joint and being coupled at the right proximal end to the right side of the first storage unit and being coupled at the right distal end to at least one of the pair of right side legs, the left arm having a left distal end with a left distal pivoting joint and a left proximal end with a left proximal pivoting joint and being coupled at the left proximal end to the left side of the first storage unit and being coupled at the left distal end to at least one of the pair of left side legs;

said storage assembly being sized and shaped to be below seat of the chair and elevated above a ground level when installed on the chair.

15. A chair according to claim 14, said storage assembly further comprising a second storage unit having a second storage feature, the second storage unit having a width that is substantially the same as the width of the first storage unit, the second storage feature comprising a storage feature from the group consisting of a recess, a case, a container, a shelf and a drawer, said second storage unit being attached to said first storage unit.

16. A chair according to claim 15, said storage assembly further comprising a third storage unit having a third storage feature, the third storage unit having a width that is substantially the same as the width of the first storage unit, the third storage feature comprising a storage feature from the group consisting of a recess, a case, a container, a shelf and a drawer, said third storage unit being attached to said first storage unit.

17. A chair according to claim 16, said first storage feature comprising a case having a base, a lid, a hinge coupling the lid to the base, a closure latch coupled to said lid, a protruding catch on the base in operable alignment with the closure latch, said closure latch configured to releasably engage the protruding catch on the base.

18. A chair according to claim 17, said second storage feature comprising a recess formed in the second storage unit.

19. A chair according to claim 18, said third storage feature additionally comprising a feature from the group consisting of a drawer in the third storage unit and a case in the third storage unit, the case in the third storage unit comprising a recess in the third storage unit, a lid configured to cover the recess in the third storage unit, a hinge coupling the lid to the third storage unit, a handle coupled to the lid, the lid being pivotable from a closed position covering the recess in the third storage unit to an open position exposing the recess in the third storage unit.

20. A storage assembly for a chair, as in claim 1, further comprising at least one attachment means operably coupled to the first storage unit and configured to securely attach to the seat of the chair.

* * * * *